US006681026B2

(12) United States Patent
Kam

(10) Patent No.: US 6,681,026 B2
(45) Date of Patent: Jan. 20, 2004

(54) RECTANGULAR TRANSDUCER FOR PANEL-FORM LOUDSPEAKER

(76) Inventor: Tai-Yan Kam, 4th Fl., No.3, 2nd Alley, 86th Lane, Chien Kung 1st Rd., Hsin Chu 300 (TW)

( * ) Notice: Subject to any disclaimer, the term of this patent is extended or adjusted under 35 U.S.C. 154(b) by 8 days.

(21) Appl. No.: 10/010,702

(22) Filed: Nov. 30, 2001

(65) Prior Publication Data

US 2003/0103642 A1 Jun. 5, 2003

(51) Int. Cl.[7] ..... H04R 25/00
(52) U.S. Cl. ..... 381/412; 381/418
(58) Field of Search ..... 381/431, 412, 381/396, 399, 421, 176, 400, 407, 417, 418, 152

(56) References Cited

U.S. PATENT DOCUMENTS 4,544,805 A * 10/1985 Sawafuji

* cited by examiner

*Primary Examiner*—Sinh Tran
(74) *Attorney, Agent, or Firm*—Trojan Law Offices

(57) ABSTRACT

A structure of a rectangular transducer is provided. The structure includes a magnet assembly, a voice coil assembly and a positioning assembly. The magnet assembly has a pair of magnetic units with a gap therebetween for generating two magnetic fields having magnetic fluxes in opposite direction within the gap. The voice coil assembly includes a slab, a coil and a suspension unit, wherein the slab is used for being attached to a panel and the coil is immersed within the gap. The positioning assembly is used for supporting and positioning the magnet assembly and the voice coil assembly. When electric current flows through the coil, the voice coil assembly generates a motion in a direction vertical to the magnetic fluxes so as to excite the panel to generate flexural vibration and radiate sound.

19 Claims, 10 Drawing Sheets

RECTANGULAR TRANSDUCER FOR PANEL-FORM LOUDSPEAKER

FIELD OF THE INVENTION

The present invention relates to a rectangular transducer for a panel-form loudspeaker, and more particularly to a rectangular transducer for exciting a flat panel of a panel-form loudspeaker to generate flexural vibration.

BACKGROUND OF THE INVENTION

A conventional loudspeaker utilizes a round-shaped electromagnetic transducer to drive a cone-type membrance to radiate sound. In general, an additional enclosure is necessary to facilitate sound radiation, which makes the loudspeaker cumbersome, weighty and having dead corner for sound radiation, etc. Recently, flat display and mobile communication devices such as notebook, cellular phone and personal digital assistant (PDA), are rapidly developed toward miniaturization. The integration of transparent panel-form loudspeakers with the flat display and mobile communication devices can greatly enhance the performance of such devices. Therefore, the conventional loudspeaker is gradually replaced by a panel-form loudspeaker.

FIGS. 1(*a*) and 1(*b*) are respectively perspective and cross-sectional views of a round-shaped transducer applied in a traditional panel-form loudspeaker. The round-shaped transducer 10 includes a round permanent magnet 11, a cup-shaped permeance unit 12, a cylindrical voice coil unit 13 and a suspension unit 14. The voice coil unit 13 has a top ring 15 to be attached onto a flat panel (not shown) of a panel-form loudspeaker. The voice coil unit 13 has a moving coil 131 supported by the suspension unit 14 and immersed within the magnetic field between the magnet 11 and the permeance unit 12. When electric current flow through the moving coil 131, the voice coil unit 13 will be forced to move back and forth vertically, thereby driving the flat panel to radiate sound.

The customarily used panels for panel-form loudspeaker include both transparent and opaque panels. When the round-transducer 10 is mounted on the peripheral edge of the transparent panel, the size of the transparent panel is reduced due to the relatively large cross-sectional area of the round-transducer 10. In addition, the attached area between the top ring 15 and the panel is also too large to be treated as a point-excitation and generate the best flexural vibration for sound radiation all of the forementioned shortcomings of the round transducer 10 are adverse for the integration of the panel-form loudspeaker with the flat display and mobile communication devices.

Therefore, the present invention provides an improved structure of transducer so as to overcome the problems described above.

SUMMARY OF THE INVENTION

It is an object of the present invention to provide a structure of a transducer in a rectangular and blade-like shape, which is suitable to be mounted on peripheral edges of a transparent panel for a panel-form loudspeaker.

It is another object of the present invention to provide a structure of a rectangular transducer having a slab attached onto a panel of a panel-form loudspeaker, wherein the length and width of the slab can be optionally predetermined so as to excite good flexural vibration.

In accordance with an aspect of the present invention, there is provided a structure of a rectangular transducer. The structure includes a magnet assembly, a voice coil assembly and a positioning assembly. The magnet assembly has a pair of magnetic units with a gap therebetween for generating two magnetic fields having magnetic fluxes in opposite direction within the gap. The voice coil assembly includes a slab, a coil and a suspension unit, wherein the slab is used for being attached to a panel and the coil is immersed within the gap. The positioning assembly is used for supporting and positioning the magnet assembly and the voice coil assembly. When electric current flows through the coil, the voice coil assembly generates a motion in a direction vertical to the magnetic fluxes so as to excite the panel to generate flexural vibration and radiate sound.

Preferably, the suspension unit includes a suspending plate having a hollow region in the center and suspending arms on the right side and left side.

Preferably, the number of the suspending arms on each of the right side and left side is 2.

Preferably, the suspending plate and the suspending arms are integrally formed.

Preferably, the coil is disposed within the hollow region. In addition, the coil is a conducting line with a plurality of winding and patterned on a printed circuit board.

Preferably, the slab and the suspension unit are integrally formed.

Preferably, the positioning assembly includes a base with a channel in the center thereof and two posts.

Preferably, the two posts are respectively mounted on both ends of the channel.

Preferably, the suspending arms are in contact with the posts on the top surfaces and bottom surfaces thereof.

Preferably, the width of each of the posts is substantially equal to the distance of the gap in the magnet assembly.

Preferably, each of the posts further includes two transverse bars on both sides for facilitating the positioning of the magnet assembly.

Preferably, the pair of magnetic units are in parallel alignment with opposite polar disposition.

Preferably, each of the magnetic units includes a magnet having poles on both vertical edge sides and sandwiched by two face pole plates.

Preferably, each of the magnetic units includes a U-shaped magnet having poles on both end sides.

Preferably, each of the magnetic units includes a free-permeable sheet sandwiched by two magnets, wherein each of the two magnets has poles on both horizontal edge sides and the two magnet are aligned with opposite polar disposition. In addition, each of the magnetic units further includes a face pole plate attached to with the free-permeable sheet and the two magnets exteriorly.

Preferably, the gap is in a range between 0.5 and 5 mm.

Preferably, the slab and the suspending unit of the voice coil assembly are made of a material selected from a group consisting of plastic and aluminum.

Preferably, the positioning assembly is made of a material selected from a group consisting of plastic and aluminum.

In accordance with another aspect of the present invention, there is provided a rectangular transducer. The rectangular transducer includes a magnet assembly having a pair of magnetic units with a gap therebetween for generating a first magnetic field and a lower magnetic field having magnetic fluxes in opposite direction within the gap, a voice coil assembly comprising a slab, a coil and a suspension unit, wherein the slab is used for being attached to a panel and the coil is immersed within the gap, and a positioning assembly for supporting and positioning the magnet assembly and the voice coil assembly, wherein the positioning assembly, the slab and the suspending unit are integrally formed, and when electric current flows through the coil, the voice coil assembly generates a motion in a direction vertical to the magnetic fluxes so as to excite the panel to generate flexural vibration and radiate sound.

Preferably, the positioning assembly, the slab and the suspending unit are made of a plastic material.

The above objects and advantages of the present invention will become more readily apparent to those ordinarily skilled in the art after reviewing the following detailed description and accompanying drawings, in which:

DESCRIPTION OF THE DRAWINGS

FIG. 1(*b*) is a cross-sectional views of a round-shaped transducer applied to a conventional panel-form loudspeaker;

DETAILED DESCRIPTION OF THE PREFERRED EMBODIMENT

Figure 1A:
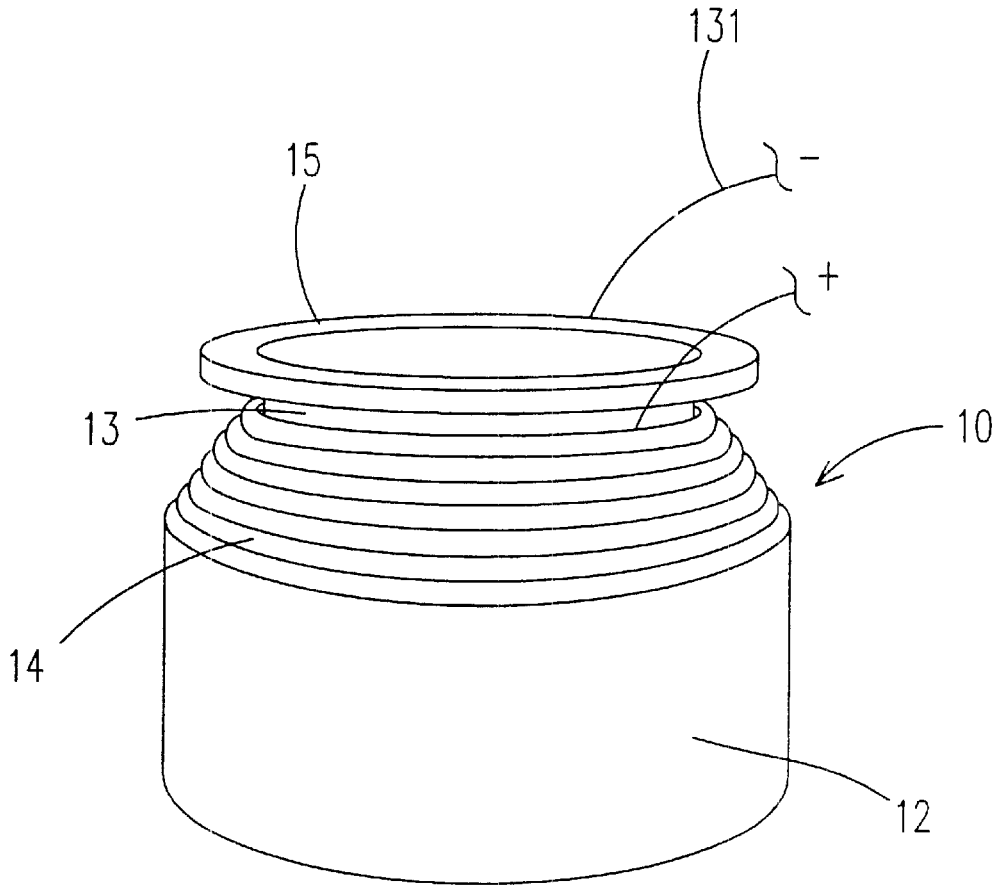
Fig. 1(a)(PRIOR ART)
FIG. 1(*a*) is a perspective view of a round-shaped transducer applied to a conventional panel-form loudspeaker.
Figure 1B:
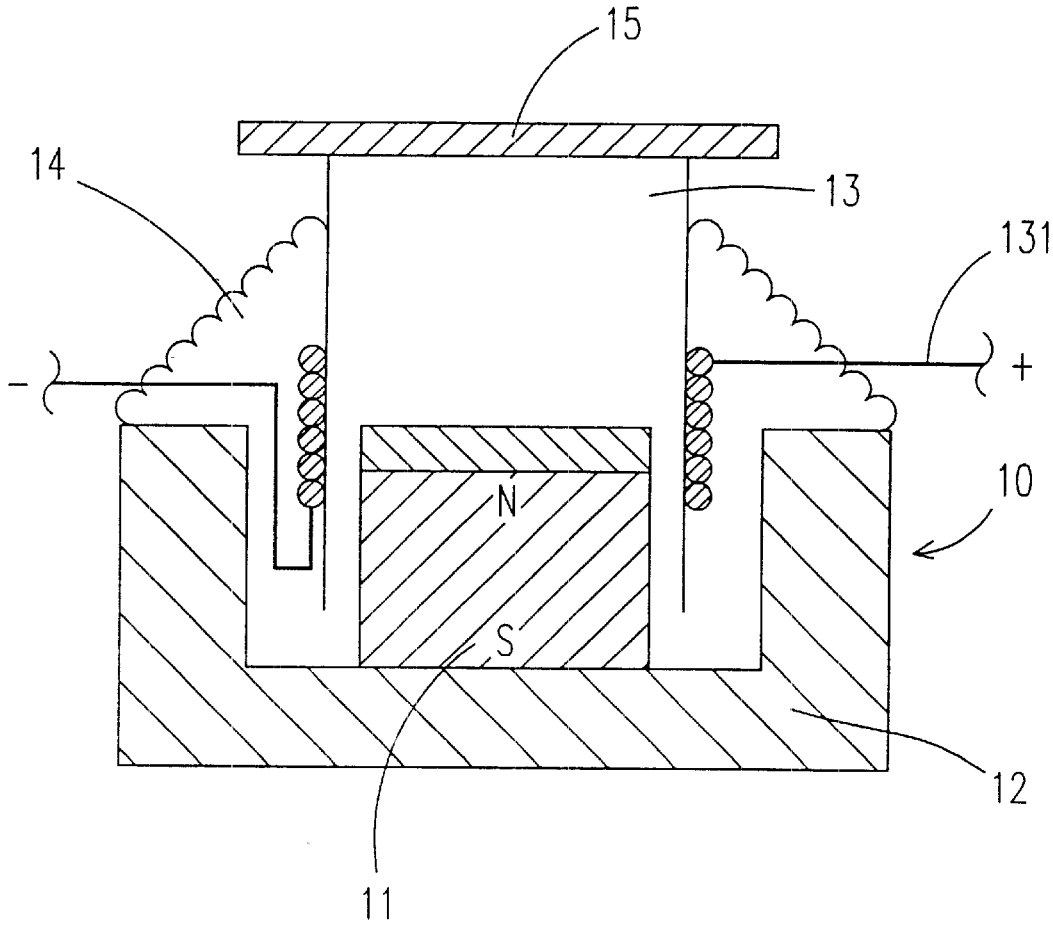
Fig. 1(b)(PRIOR ART)
Figure 2A:
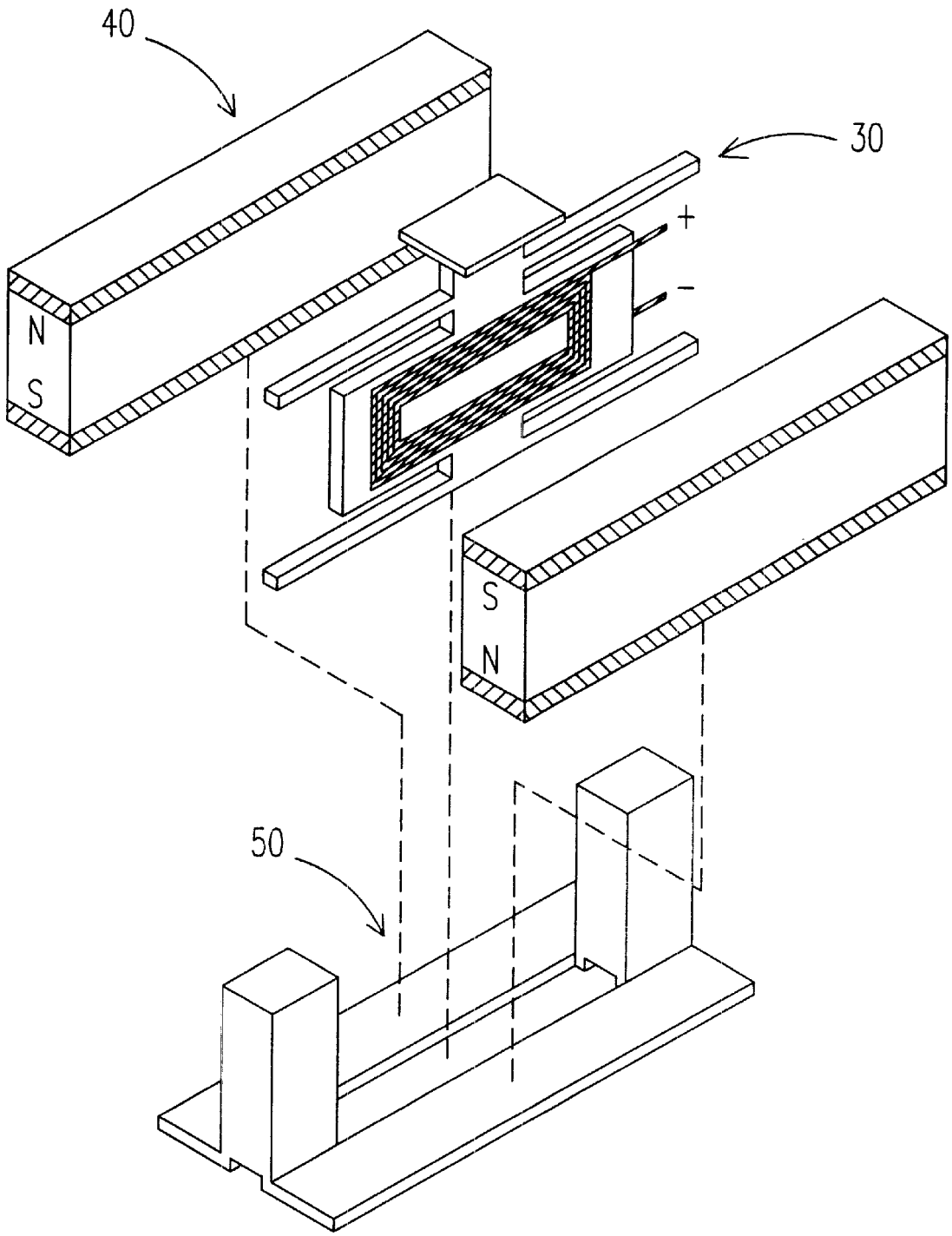
FIGS. 2(*a*) and 2(*b*) are respectively exploded and perspective views illustrating the structure of a rectangular transducer according to a preferred embodiment of the present invention.
Figure 2B:
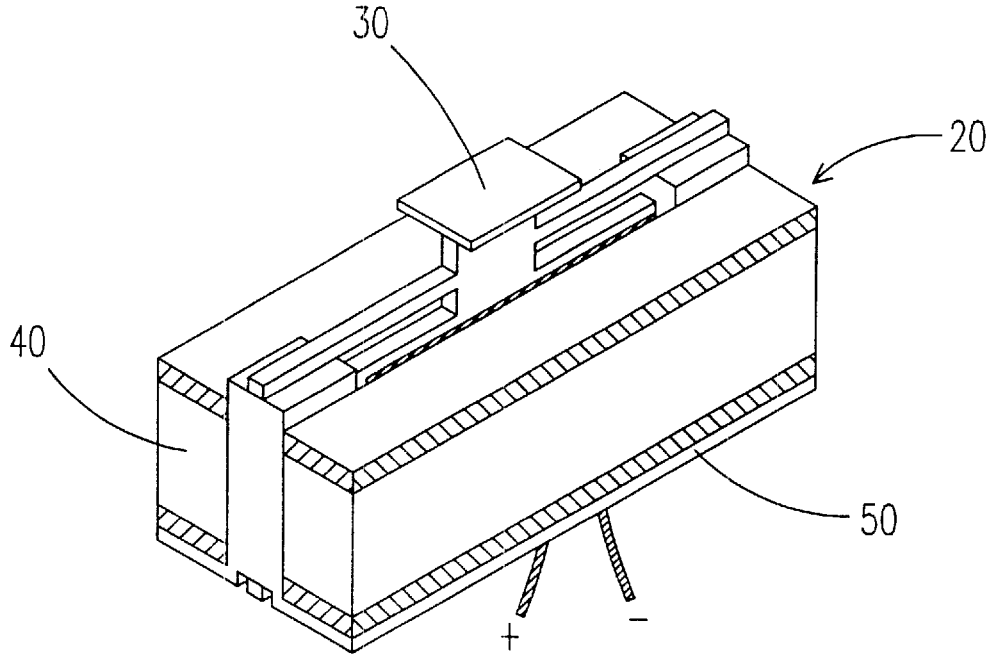

Please refer to FIGS. 2(*a*) and 2(*b*), which are respectively exploded and perspective views illustrating the structure of a rectangular transducer according to a preferred embodiment of the present invention. The rectangular transducer 20 includes a voice coil assembly 30, a magnet assembly 40 and a positioning assembly 50.

Figure 3:
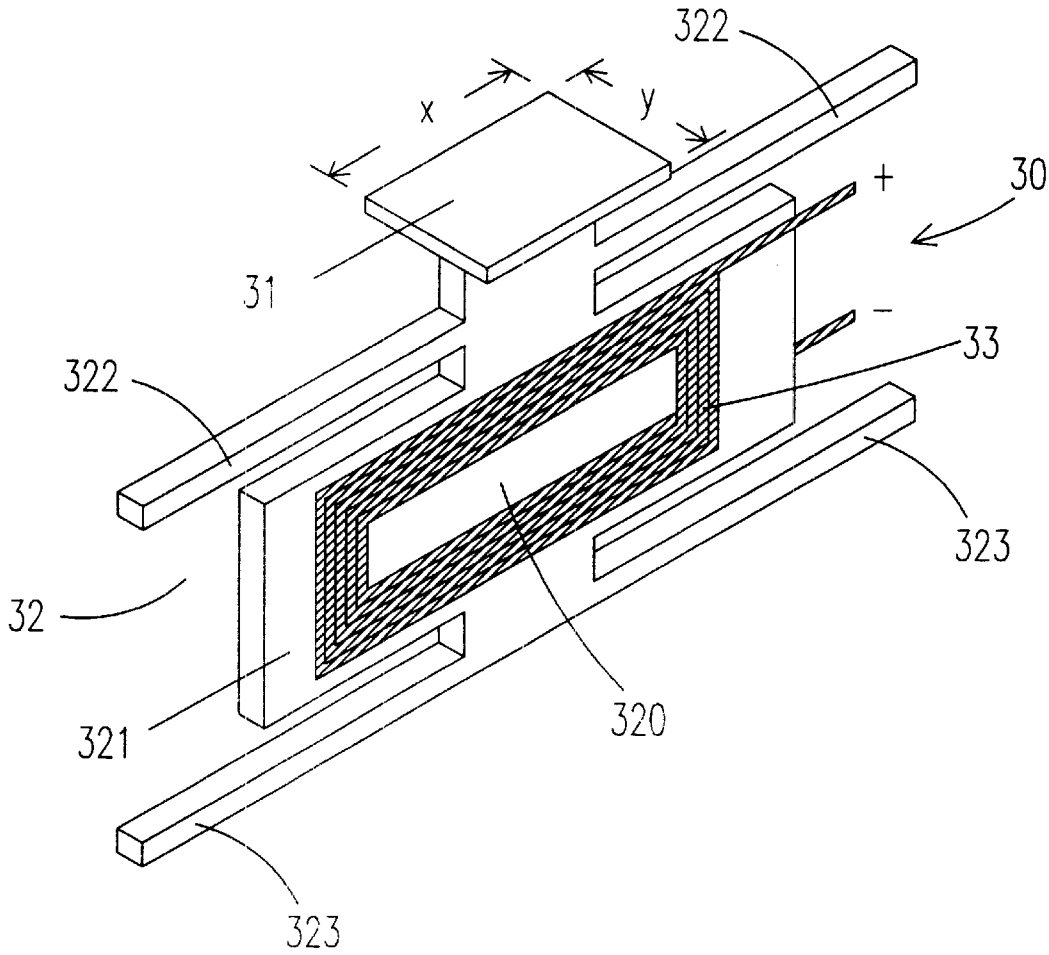
FIG. 3 is a perspective view of a voice coil assembly according to a preferred embodiment of the present invention.
Figure 4A:
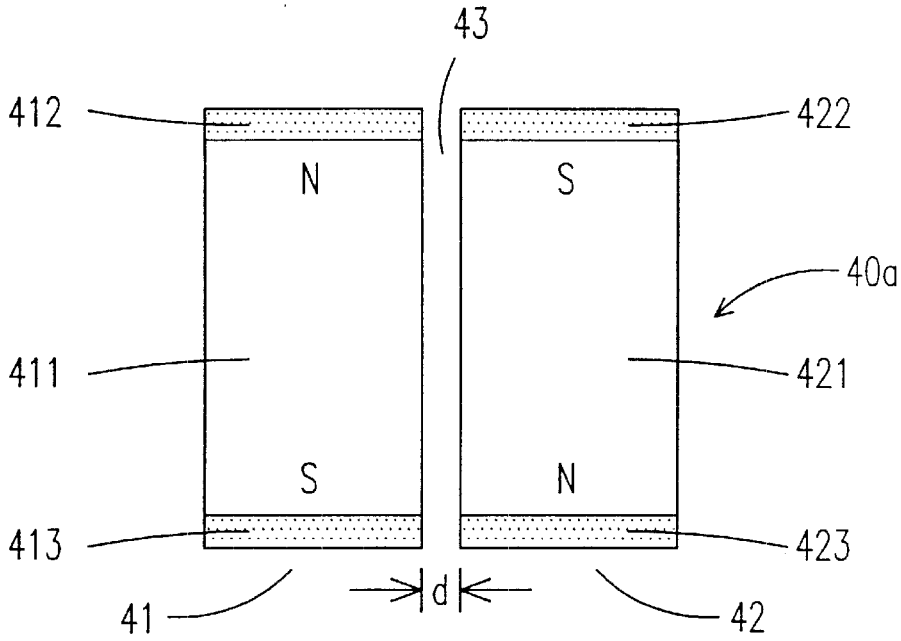
FIGS. 4(*a*) to 4(*d*) illustrate four types of magnet assemblies suitable for the rectangular transducer of the present invention.
Figure 4B:
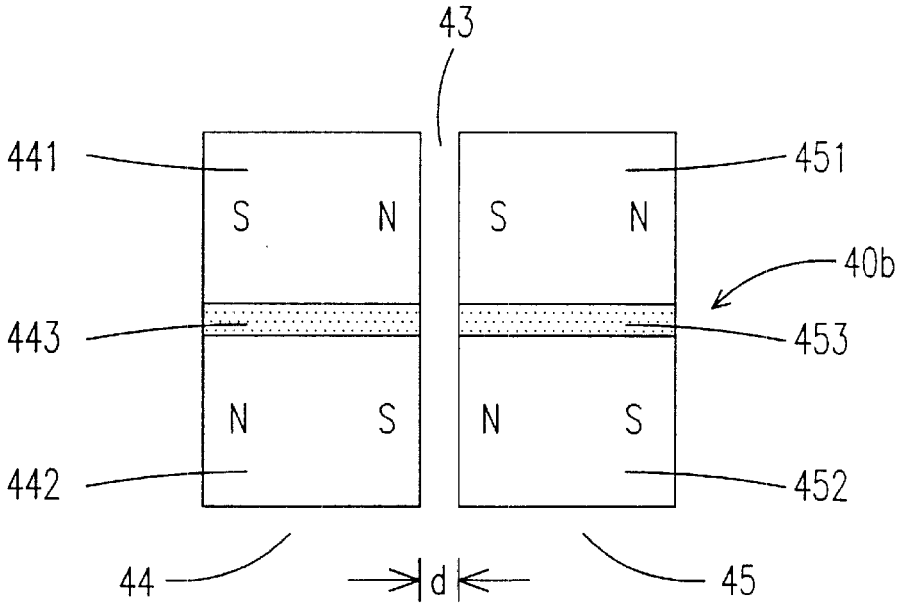
Figure 4C:
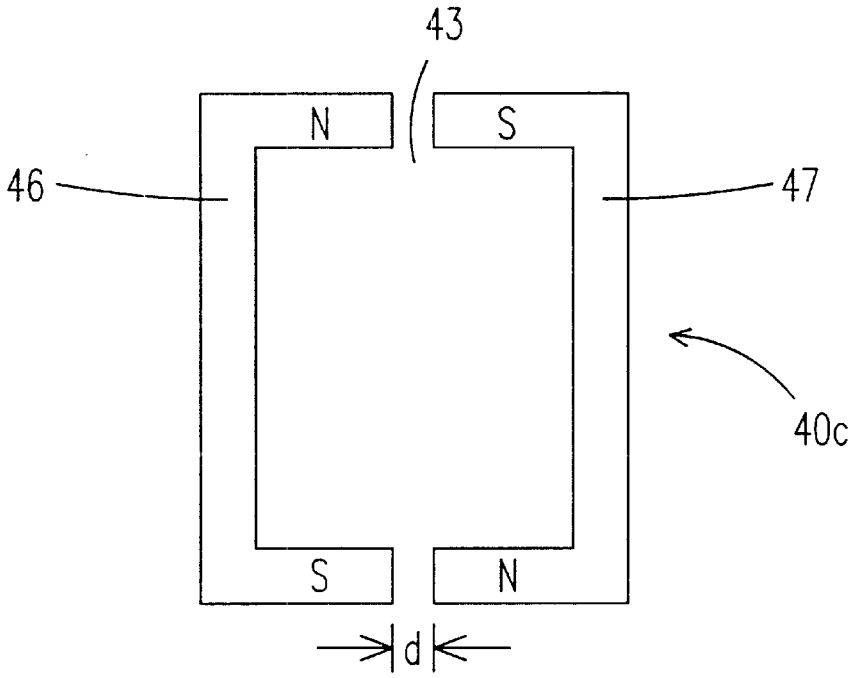
Figure 4D:
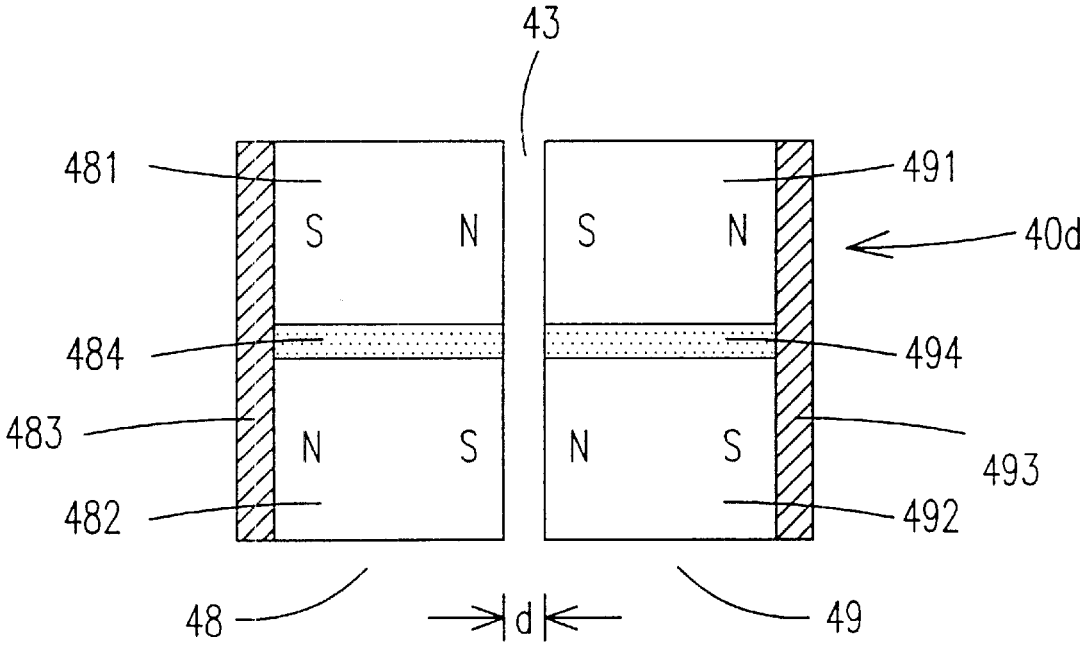

The voice coil assembly 30 includes a transverse slab 31, a suspending unit 32 and a coil 33, as can be seen in FIG. 3. The suspending unit 32 includes a vertical suspending plate 321 having a hollow region 320 in the center, two upper-side flexible suspending arms 322 and two lower-side flexible suspending arms 323. The slab 31 is used for being attached to the panel (not shown) of a panel-form loudspeaker. The suspending arms 322 and 323 are connected to or integrally formed with the suspending plate 321. The coil 33 in this embodiment is a wound wire (which is referred as a wire winding type coil) disposed within the hollow region 320. It is of course that the coil 33 can be preferably a conducting line with a plurality of winding and patterned on a printed circuit board (not shown), which is referred as a circuit board type coil. Advantageously, the suspending plate 321 and the suspending arms 322 and 323 are made of plastic material or aluminum and integrally formed by liquid injection process so as to impart resilience to the suspension unit 32. It is preferred that the slab 31 is integrally formed with the suspension unit 31. In addition, the length x and width y of the slab 31 can be optionally predetermined to excite good flexural vibration.

FIGS. 4(*a*) to 4(*d*) illustrate four types of magnet assemblies suitable for the rectangular transducer of the present invention.

In FIG. 4(*a*), the magnet assembly 40*a* is composed of a pair of magnetic units 41 and 42 with a gap 43 therebetween. In this embodiment, the distance d of the gap 43 is in a range between 0.5 and 5 mm. The magnetic unit 41 is composed of a magnet 411 having poles located at its upper and lower edge sides and sandwiched by two face pole plates 412 and 413. The magnetic unit 42 is composed of a magnet 421 having poles located at its upper and lower edge sides and sandwiched by two face pole plates 422 and 423. In addition, the pair of magnetic units 41 and 42 are in parallel alignment with opposite polar disposition. The face pole plates 412, 413 and 422, 423 are utilized to converge the fluxes produced by the magnets 411 and 412, respectively. Therefore, an upper magnetic field and a lower magnetic field which have magnetic fluxes in opposite direction are generated within the gap 43.

In FIG. 4(*b*), the magnet assembly 40*b* is composed of a pair of magnetic units 44 and 45 with a gap 43 therebetween. In this embodiment, the distance d of the gap 43 is in a range between 0.5 and 5 mm. The magnetic unit 44 includes a free-permeable sheet 443 sandwiched by two magnets 441 and 442, wherein each of the magnets 441 and 442 has poles on its left and right edge sides and these two magnets 441 and 442 are aligned with opposite polar disposition. Similarly, the magnetic unit 45 includes a free-permeable sheet 453 sandwiched by two magnets 451 and 452, wherein each of the magnets 451 and 452 has poles on its left and right edge sides and these two magnets 451 and 452 are aligned with opposite polar disposition. The thickness of each free-permeable sheets 443 and 453 is slightly larger than the distance d of the gap 43. In addition, the pair of magnetic units 44 and 45 are in parallel alignment with opposite polar disposition. Therefore, an upper magnetic field and a lower magnetic field which have magnetic fluxes in opposite direction are generated within the gap 43.

In FIG. 4(*c*), the magnet assembly 40*c* is composed of a pair of magnetic units 46 and 47 with a gap 43 therebetween. In this embodiment, the distance d of the gap 43 is in a range between 0.5 and 5 mm. Each of the magnetic units 46 and 47 is, per se, a U-shaped magnet having poles on both end sides. In addition, the pair of magnetic units 46 and 47 are in parallel alignment with opposite polar disposition. Therefore, an upper magnetic field and a lower magnetic field which have magnetic fluxes in opposite direction are generated within the gap 43.

In FIG. 4(*d*), the magnet assembly 40*d* is composed of a pair of magnetic units 48 and 49 with a gap 43 therebetween. The structure of the magnet assembly 40*d* is the same as that of 40*b*, except that each of the magnetic units 48 and 49 further includes a face pole plate (483, 493) attached to the free-permeable sheet (484, 494) and the two magnets (481, 482 and 491, 492) exteriorly. The pair of magnetic units 48 and 49 are in parallel alignment with opposite polar disposition. Therefore, an upper magnetic field and a lower magnetic field which have magnetic fluxes in opposite direction are generated within the gap 43.

Figure 5A:
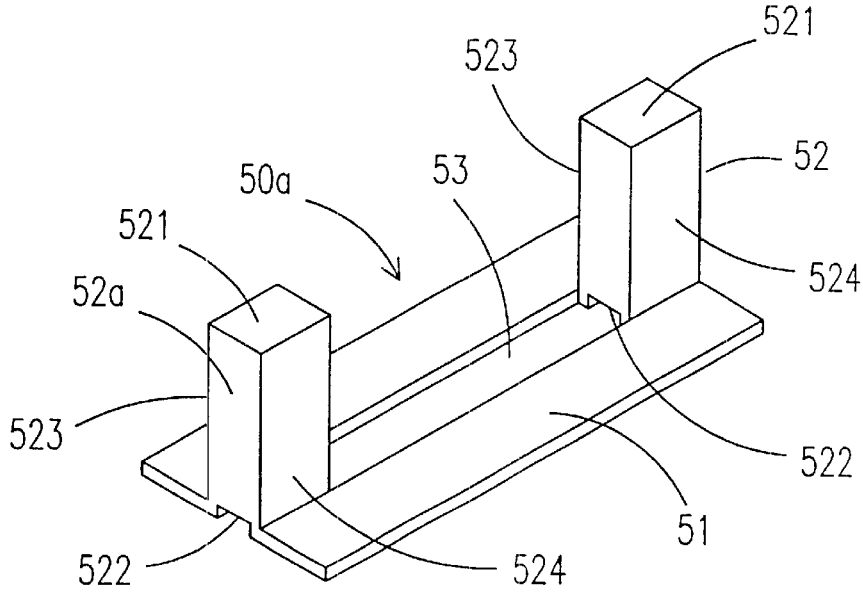
FIGS. 5(*a*) and 5(*b*) illustrate two types of positioning assemblies suitable for the rectangular transducer of the present invention.
Figure 5B:
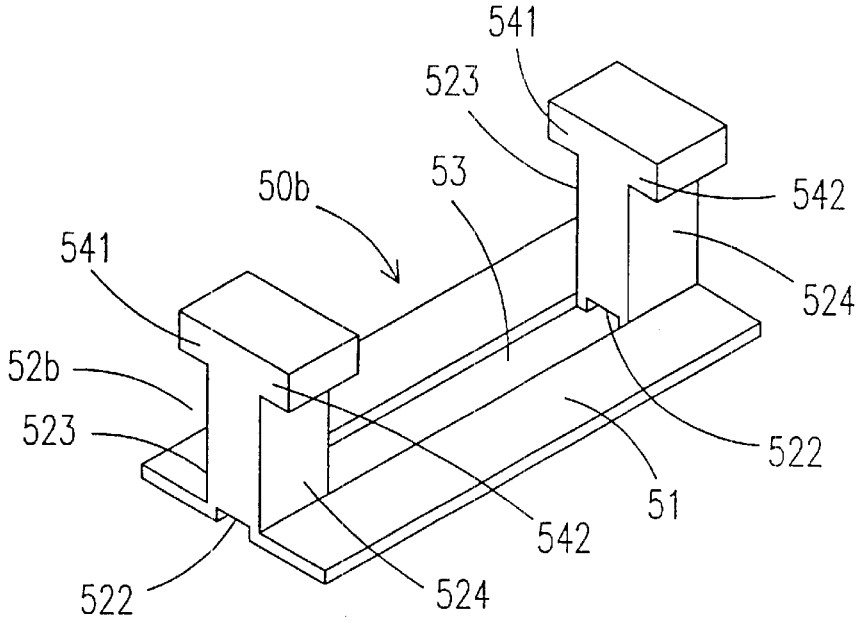

FIGS. 5(*a*) and 5(*b*) illustrate two types of positioning assemblies suitable for the rectangular transducer of the present invention.

In FIG. 5(*a*), a positioning assembly 50*a* includes a base 51 with a channel 53 in the center thereof and two posts 52*a*. The two posts 52*a* are respectively mounted on both ends of the channel 53. The width of each post 52*a* and the channel 53 is substantially equal to the distance of the gap 43. Please refer to FIGS. 2(*a*), 2(*b*) and 3 together with FIG. 5(*b*). The suspending arms 322 and 323 of the voice coil assembly 30 shown in FIG. 3 are in contact with the posts 52*a* on the top surfaces 521 and bottom surfaces 522 thereof. Therefore, the voice coil assembly 30 can be effectively positioned by the positioning assembly 50*a* and the coil 33 of the voice coil assembly 30 is immersed within the gap 43. When the pair of magnetic units of the magnet assembly 40 are respectively attached onto the base 51 and in contact with both side surfaces 523 and 524 of the posts 52*a*, the rectangular transducer 20 according to a preferred embodiment of the present invention will be finished, as can be seen in FIG. 2(*b*). Thus, when electric current flows through the coil 33, the voice coil assembly 30 will generate a motion in a direction vertical to the magnetic fluxes so as to excite the panel to generate flexural vibration and radiate sound.

In FIG. 5(*b*), the structure of the positioning assembly 50*b* is the same as that of FIG. 5(*a*), except that the posts 52*b* are T-shaped, i.e. each of the posts 52*b* further has two transverse bars 541 and 542 extended from both sides. It is believed that the transverse bars 541 and 542 are provided for facilitating positioning the magnet assembly 40 so as to prevent them from moving horizontally.

Figure 6:
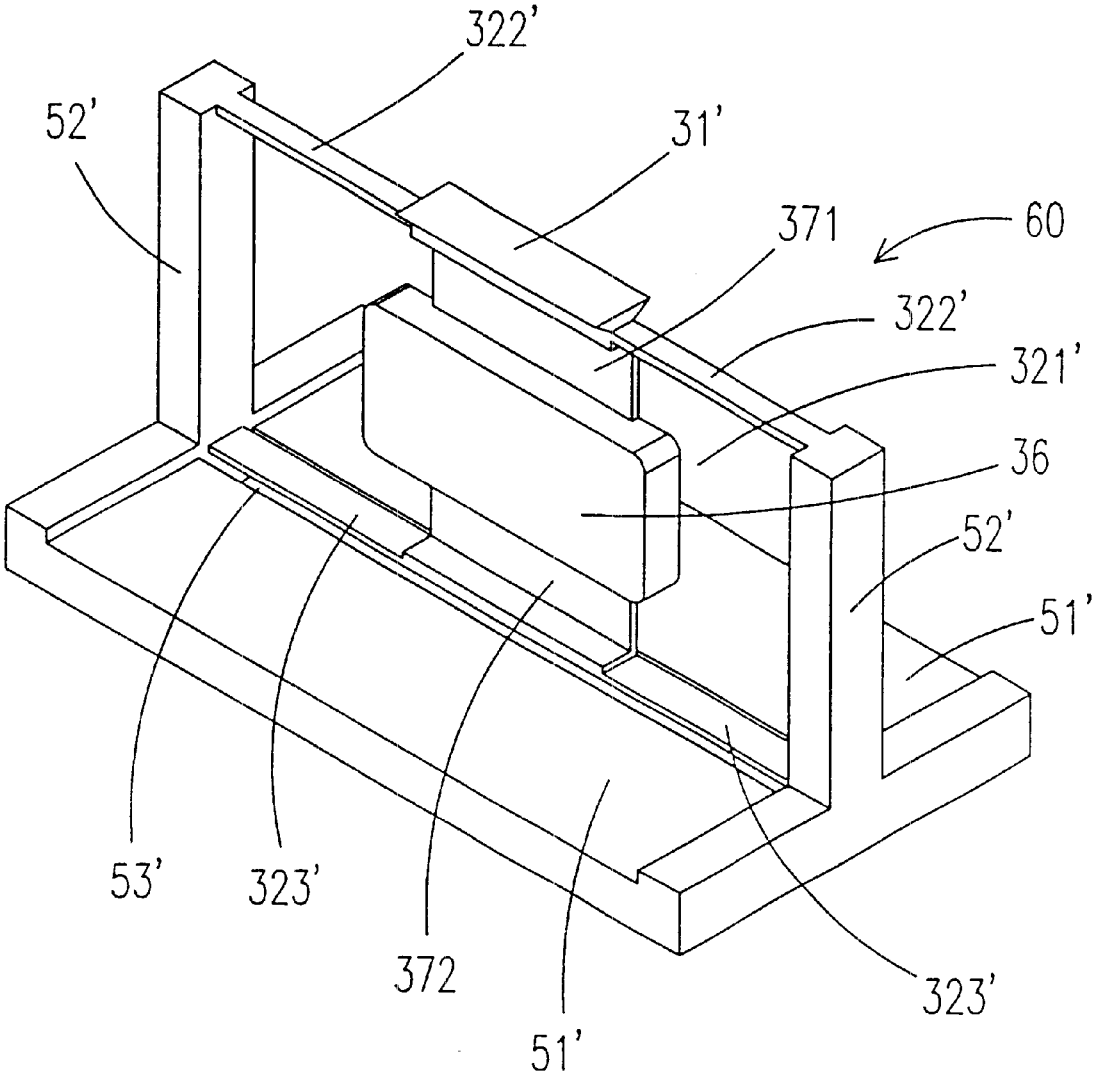
FIG. 6 is a view illustrating the positioning assembly, the slab and the suspending unit are integrally formed as a combined assembly according to the present invention.

Please refer to FIG. 6. More specially, in accordance with the present invention, the slab 31', the suspending unit (including the suspending plate 321' and the suspending arms 322', 323') and the positioning assembly (including the base 51' with a channel 53', and the posts 52') are integrally formed as a combined assembly 60. In addition, the suspending plate 321' includes a projection plate 36. The projection plate 36 is connected with the suspending arms 322', 323' via two sheets 371 and 372. The coil can be disposed on the sheets 371 and 372 and around the projection plate 36.

Figure 7:
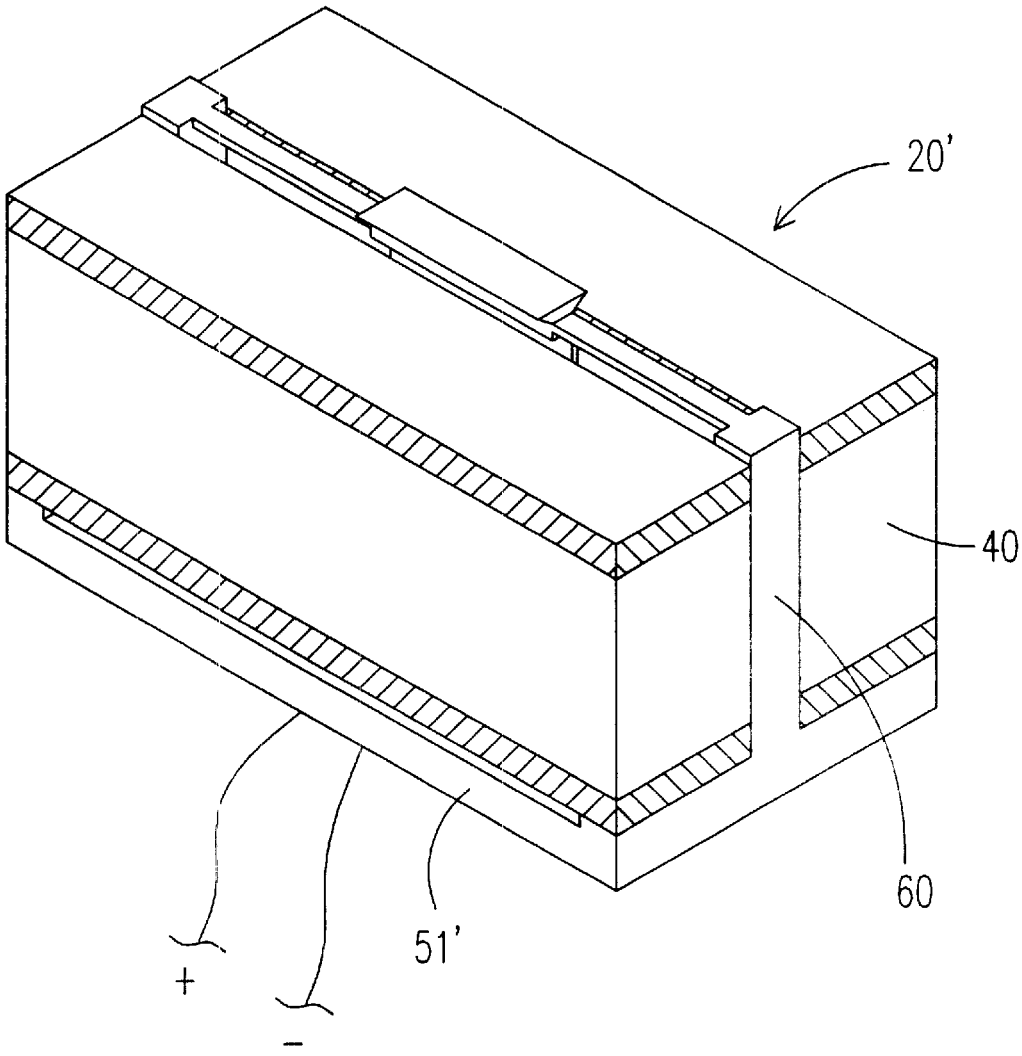
FIG. 7 is a perspective view illustrating the structure of a rectangular transducer according to another preferred embodiment of the present invention, wherein the combined assembly in FIG. 6 is utilized.

Please refer to FIG. 7. When the magnet assembly 40 is positioned on the base 51' of the combined assembly 60, another rectangular transducer 20' according to the present invention is finished.

Since the transducer of the present invention is in a rectangular and blade-like shape, it is very suitable to be mounted on the peripheral edges of a transparent panel for a panel-form loudspeaker. Thus, the rectangular transducer of the present invention can be integrated with flat display and mobile communication devices with greater flexibility and ease. Furthermore, the length and width of the slab according to the present invention can be optionally predetermined so as to excite good flexural vibration.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A structure of a rectangular transducer, comprising:

a magnet assembly having a pair of magnetic units with a gap thereberween for generating two magnetic fields having magnetic fluxes in opposite direction within said gap;

a voice coil assembly comprising a slab, a coil and a suspension unit, wherein said slab is used for being attached to a panel, said coil is immersed within said gap, and said suspension unit comprises a suspending plate having a hollow region in the center and suspending arms in the right side and left side: and a positioning assembly for supporting and positioning said magnet assembly and said voice assembly, wherein when electric current flows trough said coil, said voice coil assembly generates a motion in a direction vertical to said fluxes so as to excite said panel to generate flexural vibration and radiate sound.

2. The structure according to claim 1 wherein the number of said suspending arms in each of said right side and left side is 2.

3. The structure according to claim 1 wherein said suspending plate and said suspending arms are integrally formed.

4. The structure according to claim 1 wherein said coil is disposed within said hollow region.

5. The structure according to claim 1 wherein said coil is a conducting line with a plurality of winding and patterned on a printed circuit board.

6. The structure according to claim 1 wherein said slab and said suspension unit are integrally formed.

7. The structure according to claim 1 wherein said positioning assembly comprises a base with a channel in the center thereof and two posts.

8. The structure according to claim 7 wherein said two posts are respectively mounted on both ends of said channel.

9. The structure according to claim 7 wherein said suspending arms are in contact with said posts on the top surfaces and bottom surfaces thereof.

10. The structure according to claim 7 wherein the width of each of said posts is substantially equal to the distance of said gap.

11. The structure according to claim 7 wherein each of said posts further comprises two transverse bars on both sides for facilitating positioning said magnet assembly.

12. The structure according to claim 1 wherein said pair of magnetic units are in parallel alignment with opposite polar disposition.

13. The structure according to claim 12 wherein each said magnetic unit comprises a magnet having poles located at upper and lower edge sides and sandwiched by two face pole plates.

14. The structure according to claim 12 wherein each said magnetic unit comprises a U-shaped magnet having poles on both end sides.

15. A The structure according to claim 12 wherein each said magnetic unit comprises a free-permeable sheet sandwiched by two magnets, wherein each said two magnets has poles located at the left and right edge sides and said two magnet are aligned with opposite polar disposition.

16. The structure according to claim 15 wherein each said magnetic unit further comprises a face pole plate attached to said free-permeable sheet and said two magnets exteriorly.

17. The structure according to claim 1 wherein said gap is in a range between 0.5 and 5 mm.

18. The structure according to claim 1 wherein said slab and said suspending unit of said voice coil assembly is made of one of a plastic material and aluminum.

19. The structure according to claim 1 wherein said positioning assembly is made of one of a plastic material and aluminum.

* * * * *